US005524932A

United States Patent [19]

Kalisher

[11] Patent Number: 5,524,932

[45] Date of Patent: Jun. 11, 1996

[54] STICKER-BASED METHODS OF MAKING A PERSONALIZED CHILDREN'S STORYBOOK

[76] Inventor: Yaakov Kalisher, 5918 Bent Trail, Dallas, Tex. 75248

[21] Appl. No.: 238,321

[22] Filed: May 5, 1994

[51] Int. Cl.[6] ..... B42D 15/00

[52] U.S. Cl. ..... 283/67; 283/63.1; 283/117

[58] Field of Search ..... 283/81, 63.1, 67, 283/117; 412/1; 281/15.1

[56] References Cited

U.S. PATENT DOCUMENTS

| | | | |
|---|---|---|---|
| 3,892,427 | 7/1975 | Kraynak et al. | 281/15 R |
| 3,982,744 | 9/1976 | Kraynak et al. | 270/12 |
| 4,143,889 | 3/1979 | Scharlin | 281/15 R |
| 4,493,650 | 1/1985 | Kaufmann, III et al. | 434/178 |
| 4,714,275 | 12/1987 | Engel et al. | 281/15 R |
| 5,031,935 | 7/1991 | D'Andrea | 281/15.1 |
| 5,190,316 | 3/1993 | Hefty | 281/15.1 |

FOREIGN PATENT DOCUMENTS 8101384 10/1981 Netherlands .

*Primary Examiner*—Willmon Fridie, Jr.
*Attorney, Agent, or Firm*—Konneker & Bush

[57] ABSTRACT

A method of making a personalized children's storybook using preprinted books with textually blank areas on various ones of their pages, and adhering transparent stickers with personalized text thereon to the textually blank page areas to create a personalized story line in the book.

20 Claims, 3 Drawing Sheets

STICKER-BASED METHODS OF MAKING A PERSONALIZED CHILDREN'S STORYBOOK

BACKGROUND OF THE INVENTION

The present invention generally relates to methods of making books and the books themselves and more particularly relates to methods of making personalized children's storybooks using stickers placed on various preprinted pages of a storybook.

Various methods of making "personalized" children's storybooks—i.e., storybooks in which personal information about the child recipient is incorporated in the story line text—have been proposed and are known in the art. One previously proposed method has been to obtain personalized information pertaining to the intended child recipient, incorporate the personalized information in the story line text, print the personalized text on loose book pages, and then bind the printed pages to form a personalized storybook. While this one-at-a-time method of creating a personalized children's storybook results in a totally personalized book, it is also quite cumbersome and relatively expensive.

A sticker-based improvement in this method of making a personalized children's storybook is illustrated and described in U.S. Pat. No. 5,190,316 to Hefty and is carried out by preprinting a nonpersonalized children's storybook in which the various pages bound into the preprinted book have both nonvariable and variable textual portions. As preprinted, the storybook is complete as to its story line, but may be personalized by obtaining personal information relating to the intended child recipient of the finished book and incorporating the obtained information into textual portions printed on stickers disposed on a peel-off sticker sheet.

The variable text portions disposed on the preprinted book pages are typically located in colored areas of their associated pages which are bounded by a guide periphery having a shape identical to that of the personalized text sticker to be adhered thereto over the variable text. Once each sticker is so adhered, the sticker covers and hides the variable text, and replaces it with the personalized text on the sticker. In order to maintain the overall color scheme of the page on which each sticker is adhered, and hide the variable text which it covers, each sticker is opaque and has a color substantially identical to the guide periphery-bounded page area to which it will be adhered.

While this sticker-based method desirably permits the preprinted book to be personalized after it is purchased and given to the child recipient, the method carries with it several problems, limitations and disadvantages. For example, since the opaque stickers must be precisely aligned with the bordered variable text areas which they are designed to cover, care must be taken to properly adhere the stickers to their associated page areas to avoid exposing some of the underlying variable text and/or giving the in-place stickers undesirable misaligned appearances in the subsequently personalized storybook. This potential sticker misalignment problem is particularly acute when a small child attempts to personalize his new book.

Additionally, the necessity to match the colors of the various stickers with the variable text page areas which they will ultimately cover typically requires that separate supplies of sticker sheets, with differently colored stickers thereon, be inventoried to accommodate preprinted books with different story lines and art work therein. Because of this requirement, a seller of preprinted books with various story lines and illustrations therein can easily run out of sticker sheets for one or more of the books, while winding up with an oversupply of sticker sheets for other preprinted books in his inventory.

In view of the foregoing it can be seen that it would be desirable to provide an improved sticker-based method for personalizing a preprinted children's storybook. It is accordingly an object of the present invention to provide such an improved method and a children's storybook made thereby.

SUMMARY OF THE INVENTION

In carrying out principles of the present invention, in accordance with a preferred embodiment thereof, an improved sticker-based method is provided for making a personalized children's storybook having a children's story and optionally illustrations.

Using a method of the invention a partially completed, yet-to-be-personalized children's storybook is preprinted, with at least some of the pages of the book having a textually blank area thereon to which a sticker having personalized story line text thereon may be adhered. Prior to the personalization of the preprinted storybook, personal data about an intended recipient of the book is obtained.

The obtained personal data is incorporated with textual portions of the overall story line and imprinted on peel-off adhesive transparent stickers disposed on a sticker sheet and adapted to be adhered to associated ones of the textually blank page areas in the preprinted storybook to form therein at least a portion of the overall story line. The personalization of the preprinted book is completed by adhering the stickers to their associated textually blank page areas in the book.

Due to the combination of the transparent stickers and the textually blank page areas in the preprinted book, the personalization of the book is made easier for the adult purchaser of the book, the intended child recipient of the book, or the adult and child working together to personalize the book, since the stickers do not have to be placed over and aligned with preprinted text in the book or aligned with any guide lines or areas therein. Additionally, the use of transparent stickers instead of colored ones substantially facilitates the inventorying of sticker sheets at the point of sale because a single supply of blank sticker sheets may be used in conjunction with a wide variety of preprinted books having different story lines.

DETAILED DESCRIPTION

Figure 3:
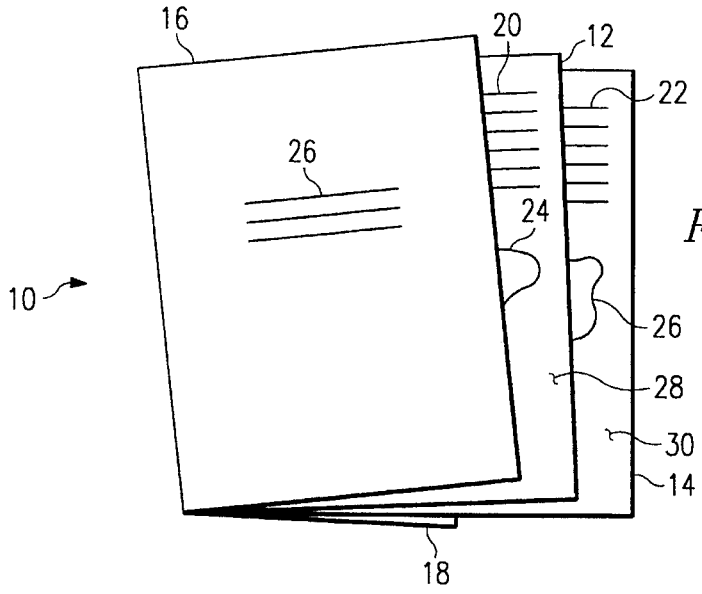
FIG. 3 is a simplified perspective view of a representative preprinted children's storybook ready to be personalized using a sticker-based personalization method incorporating methods of the present invention.
Figure 4:
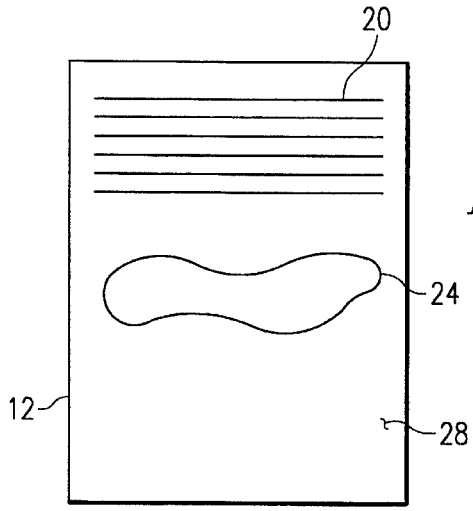
FIG. 4 is a plan view of one of the pages of the preprinted storybook.

Referring initially to FIGS. 3 and 4, the present invention provides a preprinted children's storybook 10 that may be uniquely personalized, to incorporate information pertaining to the child recipient of the book, in a manner subsequently described herein. The storybook 10, in its to-be-personalized condition shown in FIG. 3, is made and bound using conventional methods known in the art and includes a plurality of pages, representatively including pages 12 (shown by itself in FIG. 4) and 14, disposed between front and back covers 16 and 18 of the book. Various nonpersonalized text 20,22 is respectively preprinted on the pages 12,14 and an appropriate title 26 is preprinted on the front cover 16. The nonpersonalized text 20,22 is general text which is common to every preprinted book 10 of the same title, and is part of the story line of the book.

Also preprinted on the representative pages 12,14 are various pictorial illustrations 24,26 that supplement the nonpersonalized text 20,22 in the overall portrayal of the children's story in the book 10. The nonpersonalized text 20,22 is only part of the overall textual portion of the story which pages 12,14 will contain when the preprinted book 10 is personalized. To accommodate additional, personalized text on the representatively illustrated pages 12 and 14, textually blank areas 28,30 are respectively provided on the pages 12,14. These textually blank areas 28,30 are representatively devoid of both printed text and pictorial content, but could contain pictorial illustrations (either separate from or extensions of the depicted pictorial illustrations 24,26) if desired.

Figure 5:
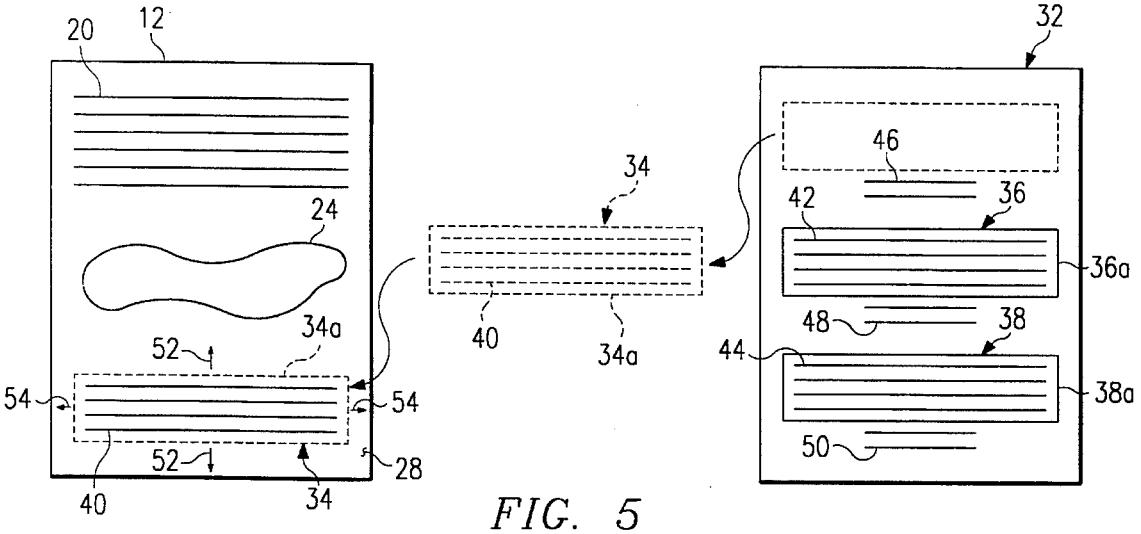
FIG. 5 is a plan view of the storybook page of FIG. 4, together with a specially designed sticker sheet, and illustrates the personalization of the page.

Referring now to FIG. 5, and using page 12 as an example, the preprinted children's storybook 10 may be personalized, by inserting in the blank page areas 28 and 30 personalized text that completes the overall story line partially defined by the nonpersonalized text 20 and 22, using a specially designed sticker sheet 32 having a plurality of peel-off transparent stickers 34,36 and 38 thereon. When the to-be-personalized book 10 is purchased, the buyer provides the seller with information pertaining to the intended child recipient of the book such as, for example, the child's name, his or her parents' names, the child's hobbies and favorite toys, the child's birthday, and the like.

This information relating to the child recipient is appropriately fed into a computer that incorporates the information into preprogrammed text that, in conjunction with the nonpersonalized text 20,22 already preprinted in the book 10, completes the story line of the book. The combination of the preprogrammed text and the personalized information incorporated therein is printed onto the transparent peel-off stickers 34,36,38 (preferably using a laser printer) to form thereon the personalized sticker text 40,42,44 indicated in FIG. 5.

Also printed on the sticker sheet 32 are placement instructions 46,48 and 50 respectively located adjacent the peel-off stickers 40,42,44 and providing instructions as to where in the preprinted book 10 to place each sticker. For example, instructions 46 could representatively read "place this sticker at the bottom of page 12". When the adult purchaser and/or the child recipient are ready to personalize the preprinted book 10 the transparent peel-off stickers 34,36,38 are removed from the sticker sheet 32 and adhered to the various pages of the book 10 in accordance with the placement instructions 46,48,50 on the sticker sheet.

For example, as representatively illustrated in FIG. 5, the transparent sticker 34 is removed from the sticker sheet 32 and adhered to a bottom portion of the sheet 12 below the pictorial illustration 24 thereon, thereby completing the textual portion of that sheet with the personalized text 40 and filling in the "blank" portion 28 of the story line on sheet 12 of the preprinted book 10.

In accordance with a key feature of the present invention, the unique combination of the transparent characteristic of the peel-off stickers 34,36,38 coupled with the use of the textually blank areas 28,30 in the preprinted book 10, the personalization of the preprinted book 10 is rendered easier for the parent, the child, or the parent and child personalizing the book together.

This is due to the fact that, unlike previous textually personalizable story books which incorporate variable text that must be covered by personalized text stickers to personalize the text of the book and require precise alignment of the stickers with printed borders surrounding the variable text, no text must be covered by the stickers 34,36 and 38, and the peripheries 34*a*,36*a*,38*a* of the stickers do not have to be aligned with any preset guide lines or guide areas preprinted on the book's pages. Thus, as indicated by the arrows 52 and 54 on the representative sheet 12 in FIG. 5 the sticker 34 may be placed somewhat above or below, or to the left or right, of its indicated position on the sheet 12 and still give the appearance, due to its transparency, of being originally printed on the sheet. In this regard the periphery 34*a* of the sticker placed on sheet 12 is shown in dotted lines to indicate that such periphery is substantially invisible on the sheet 12.

The use of the transparent stickers 34,36,38 in conjunction with the textually blank areas 28,30 on the partially preprinted pages 12,14 of the to-be-personalized storybook 10 also improves and simplifies the inventorying of sticker sheets for the illustrated preprinted book 10 and other similar preprinted books having different story lines and illustrations therein. Since the stickers 34,36,38 are transparent, they need not be color keyed to any particular book with which they are to be associated when the book is personalized. Accordingly, a large supply of unprinted sticker sheets may be ordered and kept on hand by the book seller without any concern about running out of sticker sheets for any particular personalizable storybook similar to book 10 that he keeps on his shelves.

While only two representative sheets 12,14 of the book 10 have been shown, and the single sticker sheet 32 has been representatively depicted as having three transparent stickers 34,36,38 thereon, it will readily be appreciated that the book 10 can have considerably more than two pages, and that the sticker sheet 32 can have considerably more than three transparent stickers thereon. Additionally, more than one sticker sheet can be provided in conjunction with each storybook if necessary or desirable. While the illustrated stickers 34,36,38 representatively have rectangular configurations, they could have a variety of other configurations if desired.

Figure 4A:
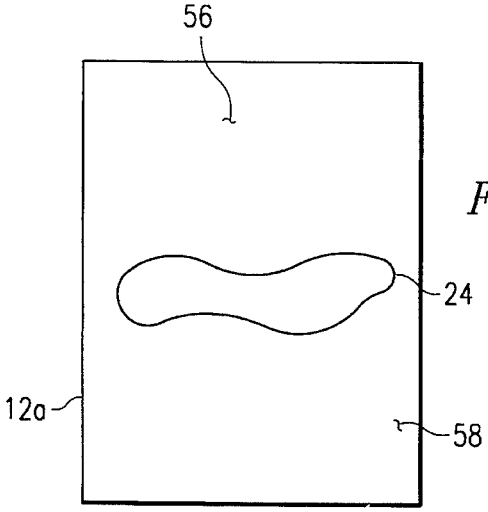
FIG. 4A is a plan view of an alternate embodiment of the FIG. 4 storybook page.
Figure 5A:
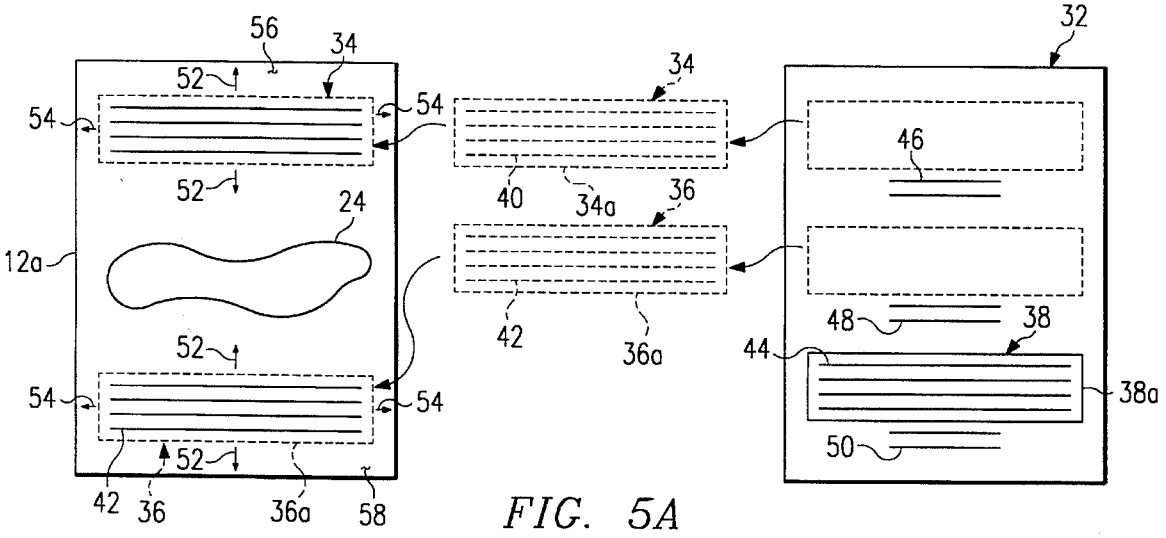
FIG. 5A is a plan view of the FIG. 4A storybook page, together with an alternate embodiment of the sticker sheet, and illustrates the personalization of the FIG. 4A storybook page.

The illustrative page 12 of the preprinted children's storybook 10 shown in FIGS. 4 and 5 representatively has preprinted nonpersonalized text 20 thereon, as mentioned above, in addition to the textually blank area 28 which will ultimately receive the transparent sticker 34 when the book is personalized. In an alternative embodiment of the preprinted book 10, one or more of its pages (for example, the illustrated page 12*a* in FIGS. 4A and 5A) may be left entirely devoid of text and have, for example, two or more textually blank areas 56 and 58 adapted to later receive two stickers 34,36 from the sticker sheet 32 as schematically illustrated in FIG. 5A. In this alternate embodiment 12*a* of the page 12 all of the text thereon is thus personalized text. If desired, all of the pages in the book 10 may be blank, and all of the text in the book may be subsequently added using personalized stickers.

As will be appreciated, the to-be-personalized book 10 may have all of its pages partially imprinted with nonpersonalized text, have some of its pages devoid of text and thus fully personalizable, or have a mixture of these two types of pages. Additionally, some of the pages may be fully imprinted with nonpersonalized text without textually blank areas adapted to receive one or more of the transparent personalized text stickers.

Figure 1:
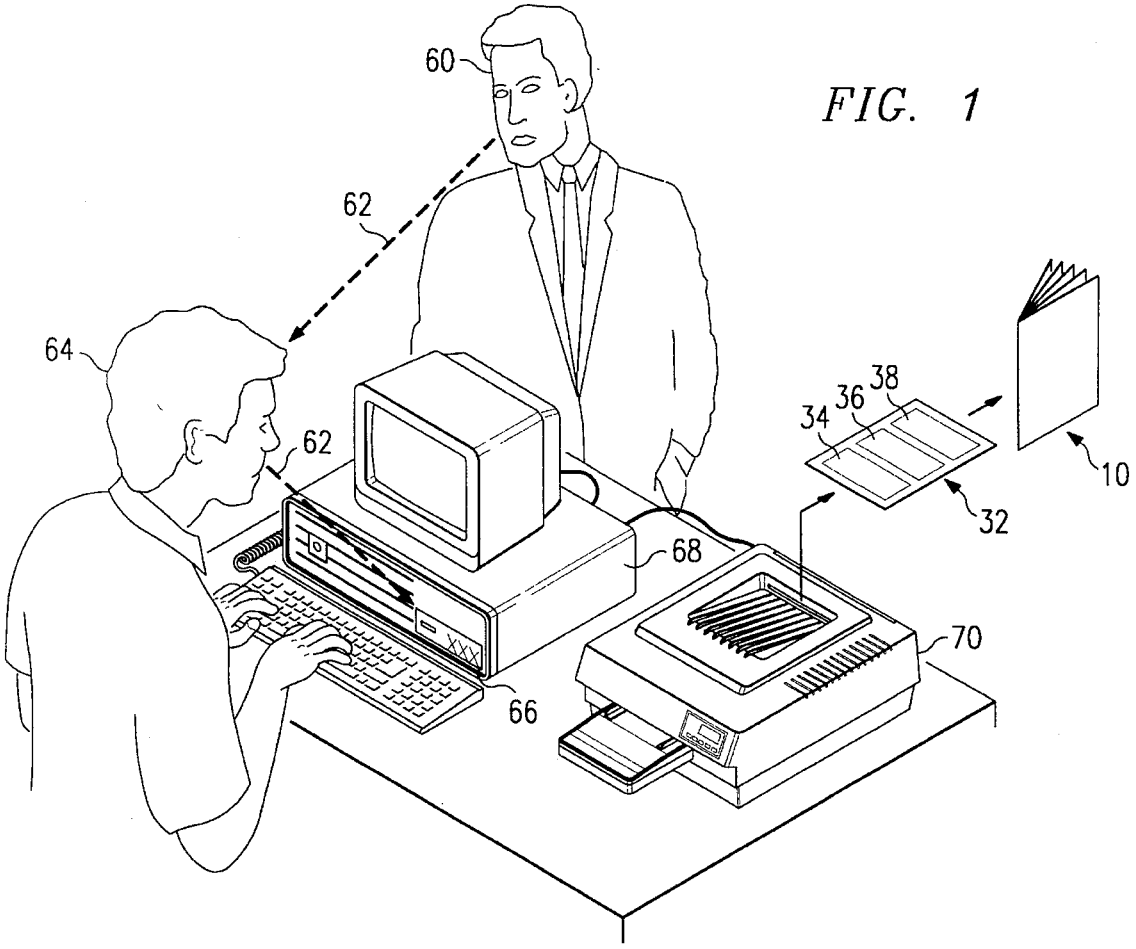
FIG. 1 is a diagram illustrating a representative overall process of producing a sticker based ready-to-personalize children's story book using a method of the present invention.

The making of a personalized children's story book in accordance with a representative method of the present invention is pictorially illustrated in the diagram of FIG. 1. As can readily be seen, a purchaser 60 conveys the necessary personalized information 62 to a computer operator 64. The computer operator then accesses a control program 66 which has the predetermined story selected by the purchaser stored on it. The control program 66 is stored in a computer 68 and is accessed by the computer operator 64.

Once the control program 66 has been accessed, the computer operator 64 enters the personalized data 62 that has been provided by the purchaser 60 into the predetermined story. After entry of the personalized data the control program 66 causes the computer 68 to transfer the data to a laser printer 70 loaded with blank sticker sheets as previously described herein. The printer 70 then prints the appropriate portions of the personalized data on the sticker portions 34,36,38 of each sticker sheet 32 which then can be used by the purchaser 60 to subsequently personalize the preprinted book 10 that he buys together with the personalized sticker sheets produced by the computer-controlled printer 70.

Figure 2:
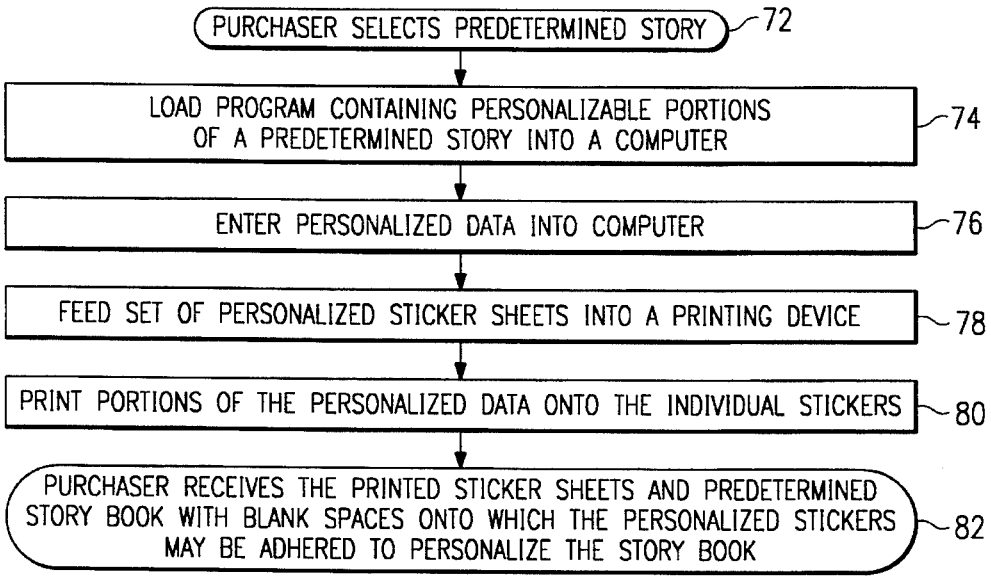
FIG. 2 is a flow chart illustrating the steps used in making a personalized children's story book in accordance with the present invention.

The flow chart shown in FIG. 2 schematically illustrates the steps used to make a personalized children's story book in accordance with a representative method of the present invention. The first step 72 requires that the purchaser 60 select a predetermined story. Once this has been accomplished, the second step 74 requires that the computer operator 64 load a control program 66 containing that selected predetermined story into the computer 68. In the third step 76, the computer operator 64 enters personalized data 62 supplied by the purchaser 60 and used by the control program 66 to create a personalized story.

As illustrated, the next step 78 is to feed a set of blank personalized sticker sheets into a printing device such as the illustrated laser printer 70. The fifth step 80 is to print portions of the personalized data 62 onto the individual stickers. In accordance with the final step 82, the purchaser receives the printed sticker sheets and the predetermined story book with blank spaces onto which the personalized stickers may be adhered to personalize the story book 10. At a later time, the story book 10 may be personalized by simply removing the stickers from their associated sticker sheets and adhering the removed stickers to the appropriate page locations in the to-be-personalized children's book 10 bought by the purchaser 60 together with the personalized sticker sheets.

The foregoing detailed description is to be clearly understood as being given by way of illustration and example only, the spirit and scope of the present invention being limited solely by the appended claims.

What is claimed is:

1. A method of making a to-be-completed personalized children's storybook having a children's story and optionally illustrations, said method comprising the steps of:

preprinting a storybook having a plurality of pages disposed therein, at least some of said pages having a textually blank area thereon to which a sticker having personalized story line text thereon may be adhered;

obtaining personal data about an intended recipient of said storybook;

providing a plurality of transparent adhesive stickers, each of which is adherable to a different one of said textually blank areas of said plurality of pages in the preprinted storybook; and printing a textual portion of the children's story on each of said transparent adhesive stickers and incorporating portions of the obtained personal data in the textual story portions, whereby the imprinted transparent adhesive stickers may be adhered to associated ones of said textually blank areas of said plurality of pages, in selectively variable locations thereon, to form on said textually blank areas personalized textual portions of said children's story.

2. A to-be-completed personalized children's storybook made by the method of claim 1.

3. The method of claim 1 wherein said preprinting step includes the step of preprinting on at least some of said pages nonpersonalized textual portions of said children's story which, together with the personalized textual portions of said children's story imprinted on said transparent adhesive stickers, complete said children's story.

4. A to-be-completed personalized children's storybook made by the method of claim 3.

5. The method of claim 1 wherein said preprinting step is performed in a manner such that at least one of said plurality of pages has no preprinted text, and has at least one of said textually blank areas, thereon.

6. A to-be-completed personalized children's storybook made by the method of claim 5.

7. The method of claim 1 wherein said step of providing a plurality of transparent adhesive stickers includes the steps of forming a plurality of peel-off transparent adhesive stickers on a sticker sheet, and printing page placement instructions on said sticker sheet adjacent the peel-off transparent adhesive stickers thereon.

8. A to-be-completed personalized children's storybook made by the method of claim 7.

9. A method of making a personalized children's storybook having a children's story and optionally illustrations, said method comprising the steps of:

preprinting a storybook having a plurality of pages disposed therein, at least some of said pages having a textually blank area thereon to which a sticker having personalized story line text thereon may be adhered;

obtaining personal data about an intended recipient of said storybook;

providing a plurality of transparent adhesive stickers, each of which is adherable to a different one of said textually blank areas of said plurality of pages;

printing a textual portion of the children's story on each of said transparent adhesive stickers and incorporating portions of the obtained personal data in the textual story portions, whereby the imprinted transparent adhesive stickers may be adhered to associated ones of said textually blank areas of said plurality of pages, in selectively variable locations thereon, to form on said textually blank areas personalized textual portions of said children's story; and adhering the plurality of imprinted, transparent adhesive stickers to their associated textually blank areas of said plurality of pages of said preprinted storybook.

10. A personalized children's storybook made by the method of claim 9.

11. The method of claim 9 wherein said preprinting step includes the step of preprinting on at least some of said pages nonpersonalized textual portions of said children's story which, together with the personalized textual portions of said children's story imprinted on said transparent adhesive stickers, complete said children's story.

12. A personalized children's storybook made by the method of claim 11.

13. The method of claim 9 wherein said preprinting step is performed in a manner such that at least one of said plurality of pages has no preprinted text, and has at least one of said textually blank areas, thereon.

14. A personalized children's storybook made by the method of claim 13.

15. The method of claim 9 wherein said step of providing a plurality of transparent adhesive stickers includes the steps of forming a plurality of peel-off transparent adhesive stickers on a sticker sheet, and printing page placement instructions on said sticker sheet adjacent the peel-off transparent adhesive stickers thereon.

16. A personalized children's storybook made by the method of claim 15.

17. For use in conjunction with a to-be-completed personalized children's storybook having a plurality of preprinted pages therein, a children's story and optionally illustrations, and a plurality of textually blank areas on said preprinted pages, a method of making a personalized sticker sheet for use in personalizing the storybook, said method comprising the steps of:

obtaining personal data about an intended recipient of said storybook;

disposing a plurality of peel-off transparent adhesive stickers on a backing sheet, each of the stickers being adapted to be adhered to a different one of the textually blank areas on the preprinted storybook pages; and printing a textual portion of the children's story on each of said peel-off transparent adhesive stickers and incorporating portions of the obtained personal data in said textual portions, whereby the imprinted peel-off transparent adhesive stickers may be adhered to associated ones of the textually blank areas of the plurality of preprinted storybook pages, in selectively variable locations thereon, to form on the textually blank areas personalized textual portions of the children's story.

18. A personalized sticker sheet made by the method of claim 17.

19. The method of claim 17 further comprising the step of printing page placement instructions on said backing sheet adjacent the peel-off transparent adhesive stickers thereon.

20. A personalized sticker sheet made by the method of claim 19.

* * * * *